US007461664B1

(12) United States Patent
Budron

(10) Patent No.: US 7,461,664 B1
(45) Date of Patent: Dec. 9, 2008

(54) ROLLER COVER END PLUG

(76) Inventor: Collin Budron, 7077 Garden Prairie Rd., Belvidere, IL (US) 61038

( * ) Notice: Subject to any disclaimer, the term of this patent is extended or adjusted under 35 U.S.C. 154(b) by 506 days.

(21) Appl. No.: 11/177,270

(22) Filed: Jul. 9, 2005

Related U.S. Application Data

(63) Continuation-in-part of application No. 10/864,589, filed on Jun. 9, 2004, now Pat. No. 7,323,066, which is a continuation-in-part of application No. 10/603,479, filed on Jun. 25, 2003, now abandoned.

(51) Int. Cl.
*B08B 3/00* (2006.01)
*B08B 9/00* (2006.01)
*B08B 3/12* (2006.01)

(52) U.S. Cl. ..... 134/138; 134/53; 134/54; 134/104.2; 134/143; 134/148; 134/166 R; 134/170; 134/172; 134/198; 134/199; 134/200

(58) Field of Classification Search ..... 134/18, 134/22.12, 24, 34, 38, 53, 55, 94.1, 98.1, 134/99.1, 103.2, 104.2, 117, 138, 143, 148, 134/149, 166 R, 167 R, 170, 172, 198, 199
See application file for complete search history.

(56) References Cited

U.S. PATENT DOCUMENTS

| | | | | | |
|---|---|---|---|---|---|
| 4,155,230 | A * | 5/1979 | Lacher, Jr. | 68/213 |
| 4,380,478 | A * | 4/1983 | Cooney | 134/38 |
| 4,672,987 | A * | 6/1987 | Brandt | 134/138 |
| 4,723,564 | A * | 2/1988 | West et al. | 134/170 |
| 5,402,808 | A * | 4/1995 | Wallis et al. | 134/104.2 |
| 5,409,027 | A * | 4/1995 | Glunt | 134/138 |
| 5,505,220 | A * | 4/1996 | Gorecki | 134/138 |
| 6,079,429 | A * | 6/2000 | Zarich | 134/182 |
| 7,323,066 | B1 * | 1/2008 | Budron | 134/38 |
| 2005/0224104 | A1 * | 10/2005 | Bleyaert | 134/151 |

* cited by examiner

*Primary Examiner*—Michael Barr
*Assistant Examiner*—Rita R Patel
(74) *Attorney, Agent, or Firm*—Kajane McManus

(57) ABSTRACT

The plug is proposed for insertion into a hollow core of a roller cover to keep water from traveling through the hollow core, the plug comprising a body sized and configured to be received in the hollow core, and the body incorporating a peripheral lip thereon to keep the plug from being pushed into the hollow core by water pressure applied thereagainst.

7 Claims, 1 Drawing Sheet

ROLLER COVER END PLUG

CROSS REFERENCE TO RELATED APPLICATIONS

This application is a continuation in part of U.S. application Ser. No. 10/864,589, filed Jun. 9, 2004 now U.S. Pat. No. 7,323,066, and entitled Paint Accessory Cleaning Device and Method, which is a continuation in part of U.S. application Ser. No. 10/603,479, filed Jun. 25, 2003, and entitled Roller Cover Cleaning Device and Method, now abandoned, the teachings of which are incorporated by reference,

BACKGROUND OF THE INVENTION

1. Field of the Invention

The present invention relates to paint accessory cleaning devices, and in particular to the device referred to above. More particularly, the plug is used with the above identified device to assure thorough cleaning of roller covers which are shorter than a length of the housing of the device.

2. Prior Art

It is not believed that such structure has heretofore been proposed.

SUMMARY OF THE INVENTION

According to the invention there is provided a plug for insertion into a hollow core of a roller cover, the plug comprising a body sized and configured to be received in the hollow core, and the body incorporating a peripheral lip thereon to keep the plug from being pushed into the hollow core by water pressure applied thereagainst.

DESCRIPTION OF THE PREFERRED EMBODIMENT

Figure 1:
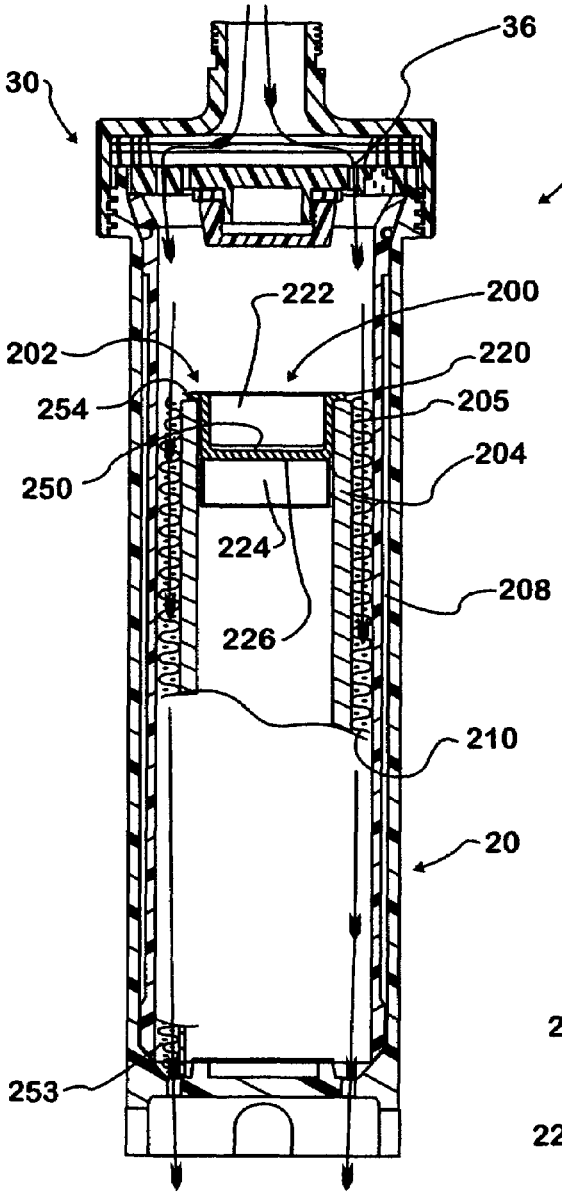
FIG. 1 is a cross sectional view through a paint accessory cleaning device showing the plug in its environment of use within a core of a roller cover which is shorter than a length of the housing of the device.
Figure 2:
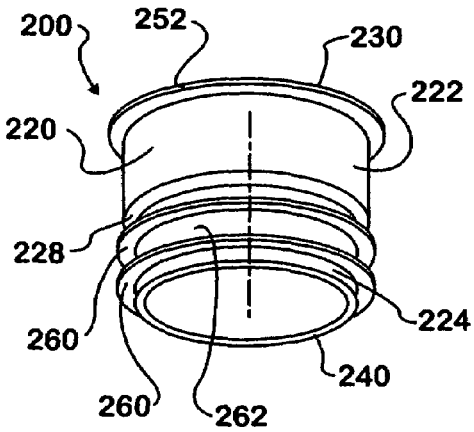
FIG. 2 is a perspective view of the plug of FIG. 1.
Figure 3:
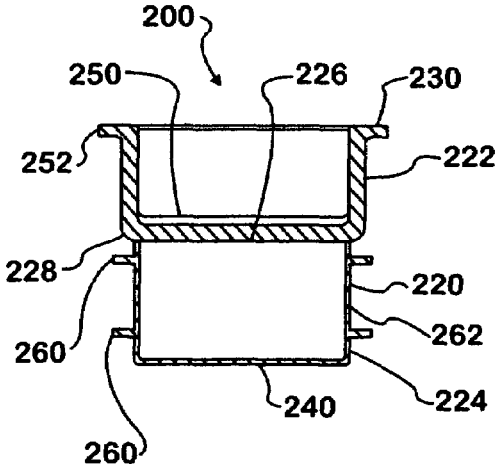
FIG. 3 is a cross sectional view through the plug of FIG. 2.

Oftentimes when painting, a roller cover which is shorter than standard (approximately 9 inches) is used.

In such instance, it has been found through empirical testing of the device 10 disclosed in copending application Ser. No. 10/684,589, that insertion of a plug 200 into one open end 202 of a hollow core 204 of the shorter roller cover 208, produces more thorough cleaning of the fibrous or nap portion 210 of a shorter roller cover 208 by directing fluid from spray apertures 36 of the device 10 therethrough, rather than allowing same to pour through the hollow core 204 thereof, by blocking access to one end 205 of the hollow core 204.

As will be seen, the plug 200 incorporates a body 220 in the form of a stepped, substantially hollow cylinder 220 divided into two longitudinal portions or sections 222 and 224, respectively, by a diametric planar wall 226 extending across the cylinder 220 at a stepped point 228, substantially longitudinally equidistant to a first or top end 230 of the cylinder 220, and a second end 240 of the cylinder 220.

The planar wall 226 is positioned thusly so that water pressure applied against a first or top surface 250 thereof, from the spray apertures 36 of the device 10, will maintain the plug 200 in the desired position within the hollow core 204.

First or free top end 230 of the plug 200 incorporates an outer peripheral lip 252 which abuts against an end edge 254 of the hollow core 204 to keep the plug 200 from traveling into the hollow core 204 when water pressure is applied against surface 250 of planar wall 226 thereof.

Section 224 of the cylinder 200 is of a diameter slightly smaller than that of hollow core 204 for ease of insertion.

Section 224 of the cylinder 200 is also of decreased diameter relative to section 222 and at least one, and preferably two, soft flexible peripheral flanges 260 are provided along an outer surface 262 of section 224 of the cylinder 200 to create at least one secondary dam against water potentially flowing past lip 252.

In use, a user inserts the plug 200 into the end 205 of shorter roller cover 208 in a manner to seat the body 220 of the plug 200 within the hollow core 204, to a point where peripheral lip 252 of the plug 200 abuts snugly against end edge 254 of the end 205 of the hollow core 204.

Opposite, unplugged end 253 of the shorter roller cover 208 is then first inserted into the housing 20 or sleeve 40 (not shown) of the device 10, and spray head 30 is then suitably engaged to housing 20, with water issuing through spray apertures 36 of spray head 30 maintaining lip 252 of plug 200 against the end edge 254 of the hollow core 204, and directing water therearound and efficiently through the nap portion 210 of the roller cover 208 for cleaning same.

As described above, the plug 200 provides a number of advantages, some of which have been described above and others of which are inherent in the invention. Also, modifications to the structure disclosed herein may be proposed without departing from the teachings herein. Accordingly, the scope of the invention is only to be limited as necessitated by the accompanying claims.

I claim:

1. For use in a device for cleaning painting accessories comprising at least a housing having an inner cavity configured to receive a roller cover therein for creating cleansing fluid flow through a nap portion of the roller cover during use in cleaning of the roller cover and a spray head top for supplying water therethrough engaged thereto, a plug inserted into a top end of a hollow core of the roller cover which is of a length less than that of the housing for directing fluid through the nap of the roller cover by diverting the water away from the hollow core, the plug comprising a hollow cylindrical body having a first portion and a second portion, the first portion being separated from the second portion by a diametric wall extending across a diameter of the body, the second portion being of smaller diameter than the first and having at least one flange along a peripheral outer surface thereof, and the first portion having a peripheral lip along a free top end thereof, the peripheral lip abutting against an end edge of the hollow core into which the plug is seated.

2. The device for cleaning painting accessories of claim 1 comprising at least a housing having an inner cavity configured to receive a roller cover therein; and a spray head for supplying cleansing fluid to the housing engaged to the housing, the improvement comprising a plug inserted into a hollow core of the roller cover for diverting water applied thereagainst through the nap of the roller cover rather than allowing passage thereof through the hollow core of the roller cover.

3. A plug inserted into a top end of a hollow core of a roller cover inserted into a housing of a paint accessory cleaning device, the plug comprising a body sized and configured to be received within the hollow core, and the body incorporating a peripheral lip thereon to keep the plug from being pushed into the hollow core by water pressure applied thereagainst, wherein the body is a hollow cylinder comprised of two portions and the portions are created to either side of a diametric wall extending across a diameter of the body within the hollow cylinder.

4. The plug of claim 3 wherein a first top portion has a peripheral lip along a top free edge thereof.

5. The plug of claim 4 wherein second portion of the plug is of reduced diameter relative to the first portion.

6. The plug of claim 5 wherein the second portion incorporates at least one peripheral flange.

7. The plug of claim 6 wherein the second portion incorporates two peripheral flanges.

* * * * *